US008744291B2

(12) United States Patent
Kobayashi

(10) Patent No.: US 8,744,291 B2
(45) Date of Patent: Jun. 3, 2014

(54) IMAGE-FORMING APPARATUS AND METHOD FOR CONTROLLING IMAGE-FORMING APPARATUS

(71) Applicant: Kyocera Document Solutions Inc., Osaka (JP)

(72) Inventor: Kimihiko Kobayashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/747,717

(22) Filed: Jan. 23, 2013

(65) Prior Publication Data

US 2013/0195478 A1 Aug. 1, 2013

(30) Foreign Application Priority Data

Jan. 27, 2012 (JP) ..... 2012-015201
Jan. 10, 2013 (JP) ..... 2013-002530

(51) Int. Cl.
*G03G 15/20* (2006.01)
*G03G 15/00* (2006.01)

(52) U.S. Cl.
USPC ..... 399/33; 399/18; 399/67

(58) Field of Classification Search
USPC ..... 399/18, 33, 67, 88, 167
See application file for complete search history.

(56) References Cited

U.S. PATENT DOCUMENTS 8,666,268 B2 * 3/2014 Watanabe et al. ..... 399/33

FOREIGN PATENT DOCUMENTS

JP 7-261597 10/1995

* cited by examiner

*Primary Examiner* — Hoang Ngo
(74) *Attorney, Agent, or Firm* — Morgan, Lewis & Bockius LLP

(57) ABSTRACT

An image-forming apparatus includes a power-source part, a fixing device, a power-source switch, a memory part, a fixing motor, and a drive-transmitting part. The power-source part generates and supplies voltage. The fixing device includes a rotating heating body, a heater, and a rotating pressing body. The power-source switch turns off a power source of the image-forming apparatus. The memory part stores recorded data that the power source was turned off due to the operation of the power-source switch. When the recorded data is stored in the memory part, electric power is applied to the fixing motor so as to initiate rotation at a first torque, and when the recorded data is not stored, electric power is applied to the fixing motor so as to initiate rotation at a second torque, which is less than the first torque.

16 Claims, 6 Drawing Sheets

IMAGE-FORMING APPARATUS AND METHOD FOR CONTROLLING IMAGE-FORMING APPARATUS

This application is based on and claims the benefit of priority from the following Japanese Patent Application, the contents of which are hereby incorporated by reference:

(1)Japanese Patent Application No. 2012-015201 filed Jan. 27, 2012

(2)Japanese Patent Application No. 2013-002530 filed on Jan. 10, 2013

BACKGROUND

The present disclosure relates to an image-forming apparatus for using heat and pressure to fix paper to which a toner image has been transferred, and to a method for controlling the image-forming apparatus.

In image-forming apparatuses such as printers, multifunctional peripherals, copy machines, and FAX apparatuses, printing is performed by fixing a toner image that has been transferred to paper on the paper. Such image-forming apparatuses are provided with a fixing device that includes a heater and a rotating heating body such as a roller that is heated by the heater and melts the toner. Abnormalities in which the temperature of members such as the roller within the fixing device becomes excessively high may occur as a result of a breakdown in the switch for energizing the heater, a malfunction in the control circuit for controlling the energization of the heater, a crash, or a variety of other causes. The temperature of the fixing device must therefore be prevented from continuing to increase when abnormalities occur.

For example, fixing devices such as that described below are well known. Specifically, fixing devices that are provided with a fixing roller for bearing the downward load from a pressing roller and houses an electric heater, fixing-roller-bearing means that are formed from a thermoplastic resin and hold the fixing roller, a power-source-supplying circuit for supplying a power source to the electric heater, and power-source-supply-blocking means for blocking the power-source-supplying circuit as a result of the fixing roller dropping due to melting of the fixing-roller-bearing means. According to this configuration, in cases where the temperature of the fixing roller has abnormally increased, a rib member melts, and the fixing roller that bears the load from the pressing roller moves in the direction of the load (the downward direction). The connection between the electric heater and the power-source-supplying circuit is blocked in concert with this movement. The need for components and attachments such as thermostats is thereby removed, and costs are reduced.

A fixing device that includes the heater, a rotating heating body for using the heat of the heater to heat the toner image, and a rotating pressing body for pressing against the rotating heating body and applying pressure to the toner image is provided to the image-forming apparatus, as described above. For applying enough pressure the paper, that the rotating pressing body, which is formed from an elastic material such as an elastic resin or a silicone sponge, is pushed against the rotating heating body. The paper to which the toner image has been transferred is passed through the nip portion between the rotating heating body the rotating pressing body. The toner image is thereby heated, pressed, and fixed on the paper.

When the rotating heating body and the rotating pressing body are not made to rotate while energizing the heater, the heat from the rotating heating body concentrates only in those portions of the rotating pressing body that are pressed against the rotating heating body (the temperature increases only in the contacting portions). When this state continues, the temperature of the portions of the rotating pressing body that contact the rotating heating body increases enough that the elastic material begins to melt. When the rotating pressing body begins to melt, a part (the elastic material) of the melted rotating pressing body will adhere to the rotating heating body. When the temperature decreases, the part of the melted rotating pressing body is affixed to the rotating heating body, and the rotating heating body and the rotating pressing body enter a state of integration (referred to as "welding" below). In order to prevent welding, the rotating heating body and the rotating pressing body are made to rotate in high-temperature states in which the heater is energized, and the rotating heating body is heated.

However, the supply of electric power to the image-forming apparatus and the motor that causes the rotating heating body and the rotating pressing body to rotate may suddenly be blocked. The supply of electric power to the image-forming apparatus and the motor may be suddenly blocked in cases where the power cord is pulled out, whether intentionally or as a result of tripping or another accident, cases of pulling-off of the power cords, cases of electric power outage, cases of errors occurring in the circuits related to electrical supply in the image-forming apparatus, or other such cases.

The rotating heating body and the rotating pressing body that were rotating will stop when the electric power supply to the motor is suddenly blocked. Welding may occur when the electric power supply is suddenly blocked in a state in which large amounts of electric power are supplied to the heater for printing or for increasing the temperature of the rotating heating body to a temperature determined in advance (for warming up).

When welding occurs, the rotating heating body and the rotating pressing body will be unable to rotate. Despite the fact that welding prevents rotation, when the motor that causes the rotating heating body and the like to rotate is driven, and drive force is applied, problems may be presented in that the teeth of the gears that transmit the drive force may break off, or other breakage may occur. The motor will be in a locked state, and therefore a large electrical current will flow to the motor for causing the rotating heating body and the rotating pressing body to rotate, temperature increases in the winding and the like in the motor, and the motor may be broken. Beyond the occurrence of welding, problems are thus presented in that the number of malfunctioning sites increases when drive-transmitting portions and the like are broken, and significant repairs are necessary.

The technology according to the aforedescribed fixing device is such that temperature increases in the fixing device are stopped at a set temperature. However, this technology has no bearing on problems of drive force being applied upon the occurrence of welding, whereby gears are broken. The aforedescribed problems therefore cannot be solved. Another aspect of the technology according to the aforedescribed fixing device is that there is no necessary to provide thermostats and temperature fuses. Temperature increases up to the temperature sufficient to melt the rib are therefore permitted. However, when the temperature increases there are concerns not only of welding but of melting of resin members, which include the periphery of the fixing device, and the possibility exists that image-forming apparatus will be irreparably damaged. Therefore, from the perspective of minimizing breakage, the technology according to the aforedescribed fixing device presents many problems.

SUMMARY

In order to solve the aforedescribed problems, an image-forming apparatus according to a first aspect of the present disclosure includes a power-source part, a fixing device, a power-source switch, a memory part, a fixing motor, and a drive-transmitting part. The power-source part connects to an external power source, and generates and supplies voltage necessary for the operation of the image-forming apparatus. The fixing device includes a rotating heating body, a heater by using energization to heat the rotating heating body, and a rotating pressing body, which has an elastic layer, presses against the rotating heating body to form a nip portion. The fixing device passes paper through the nip portion and performs fixation, a toner image having been transferred to the paper. The power-source switch is a switch for turning off a power source of the image-forming apparatus. The memory part stores recorded data for indicating that the power source of the image-forming apparatus was turned off due to the operation of the power-source switch. Upon activation of the memory part due to powering-on of the image-forming apparatus, when the recorded data concerning a previous instance of the power source of the image-forming apparatus being turned off is stored in the memory part, electric power is applied to the fixing motor so as to initiate rotation at a first torque, and when the recorded data is not stored in the memory part, electric power is applied to the fixing motor so as to initiate rotation at a second torque, which is less than the first torque, and the rotating heating body and the rotating pressing body are made to rotate. The drive-transmitting part includes a plurality of gears, transmits the drive force of the fixing motor to one or both of the rotating pressing body and the rotating heating body, and causes the rotating pressing body and the rotating heating body to rotate.

In order to solve the aforedescribed problems, a method for controlling an image-forming apparatus according to a second aspect of the present disclosure includes causing a power-source part to generate a voltage necessary for operating the image-forming apparatus; energizing a heater and heating a rotating heating body; pressing a rotating pressing body against the rotating heating body and forming a nip portion, the rotating pressing body having an elastic layer; causing paper onto which a toner image has been transferred to pass through the nip portion and undergo fixation; using a power-source switch to turn off a power source of the image-forming apparatus; storing in a memory part recorded data indicating that the power source of the image-forming apparatus was turned off due to operation of the power-source switch; applying electric power, when the memory part is activated due to powering-on of the image-forming apparatus, to a fixing motor for initiating rotation of the fixing motor at a first torque when the memory part stores the recorded data concerning a previous instance of turning off of the power source of the image-forming apparatus; applying electric power, when the recorded data is absent from the memory part, to the fixing motor for initiating rotation of the fixing motor at a second torque that is less than the first torque; using the fixing motor to cause the rotating heating body and the rotating pressing body to rotate; and using a drive-transmitting part to transmit drive force of the fixing motor to one or both of the rotating pressing body and the rotating heating body and to cause the rotating pressing body and the rotating heating body to rotate.

Further features and advantages of the present disclosure will become apparent from the description of embodiments given below.

BRIEF DESCRIPTION OF THE DRAWINGS

FIG. 6 is a flowchart showing the process flow for warming-up the fixing device when the printer is powered on.

DETAILED DESCRIPTION

Provided below is a description of embodiments of the present disclosure, with reference to FIGS. 1 to 6. This description relates to an example in which a printer 100 serves as the image-forming apparatus. However, the configurations, arrangements, and other various elements described in the embodiments do not limit the scope of the disclosure but rather are provided merely by way of descriptive example.

(Overview of the image-forming apparatus)

Figure 1:
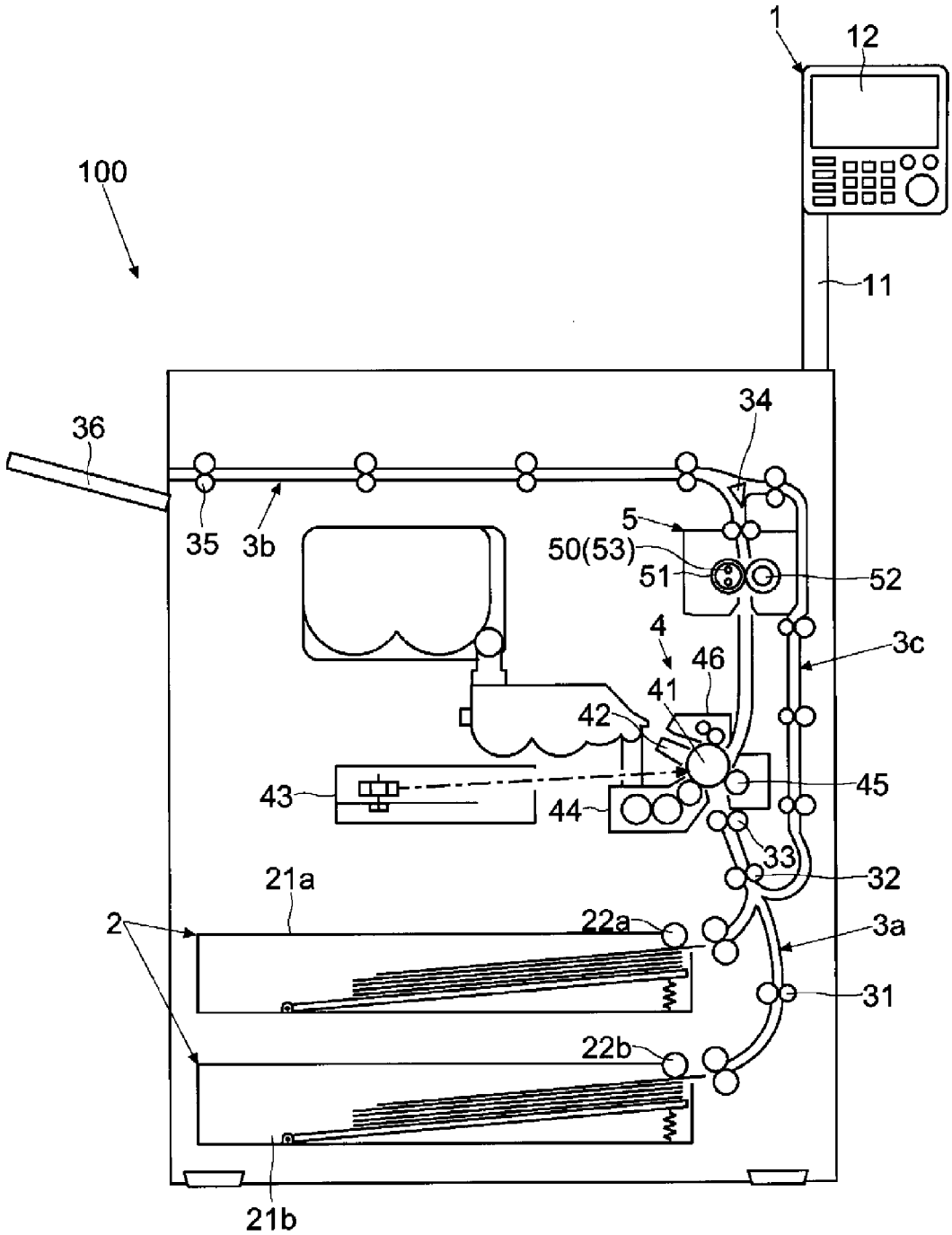
FIG. 1 is a cross-sectional view showing the structure of the printer.

An overview of the printer 100 according to the embodiment will be given first, using FIG. 1. FIG. 1 is a cross-sectional view showing the structure of the printer 100.

The printer 100 of the present embodiment has an operating panel 1 (corresponding to a notification part) attached on the side, as shown in FIG. 1. A paper-feeding part 2, a first conveying part 3*a*, an image-forming part 4, a fixing device 5, a second conveying part 3*b*, and the like are included within the printer 100.

The operating panel 1 is provided to the end of an arm 11 provided to the upper right side of the printer 100, as shown in FIG. 1. The operating panel 1 is provided with a liquid-crystal display part 12 for displaying the state of the printer 100, various types of messages, and settings screens. The liquid-crystal display part 12 is a touch panel (e.g., a resistance-film type). The operating panel 1 performs the role of an operating part for receiving input of paper type, size, other printing conditions, or other settings from the user to be used when printing, as well as for receiving [commands to] clear error states and error displays. The operating panel 1 displays the state of the apparatus, warnings, error messages, and other information on the liquid-crystal display part 12 and makes notifications to the user.

The paper-feeding part 2 is positioned in the lower interior of the printer 100, as shown in FIG. 1. The paper-feeding part 2 has a plurality of cassettes 21 (in FIG. 1, the upper cassette is labeled 21*a*, and the lower cassette is labeled 21*b*). The cassettes 21 accommodate copy paper, OHP sheets, sheets of labels, and other types of paper. A paper-feeding roller 22 that is made to rotate by a motor M2 (see FIG. 4) or other driving mechanism (not shown) is provided to the cassettes 21 (in FIG. 1, the upper roller is labeled 22*a*, and the lower roller is labeled 22*b*). The paper-feeding rollers 22 rotate and feed paper to the first conveying part 3*a*.

The first conveying part 3*a* conveys paper within the printer 100. The first conveying part 3*a* guides paper supplied from the paper-feeding part 2 to the image-forming part 4. Conveying-roller pairs 31, 32, a resist-roller pair 33, and the like are provided to the first conveying part 3*a*. The resist-roller pair 33 causes the conveyed paper to pause in front of the image-forming part 4 (transfer roller 45) and sends the paper forward using a predetermined timing.

The image-forming part 4 forms a toner image on the basis of image data for the image to be formed and transfers the toner image to the paper. Specifically, the image-forming part 4 includes a photosensitive drum 41, positioned in the vicinity of the photosensitive drum 41, a charging part 42, an exposure part 43, a development part 44, the transfer roller 45, a cleaning part 46, and other parts.

The photosensitive drum 41 has a photosensitive layer on the outer circumferential surface. The toner image can be supported on this circumferential surface. The photosensitive drum 41 is driven to rotate at a predetermined process speed. The charging part 42 charges the photosensitive drum 41 at a set potential. The exposure part 43 outputs a laser beam, which is shown as a dashed-dotted line in FIG. 1, on the basis of an inputted image signal (image data), performs a scanning exposure of the charged photosensitive drum 41, and forms an electrostatic latent image on the surface of the photosensitive drum 41. The exposure part 43 receives image-processed image data through a control part 6 and an image-processing part 62 and then irradiates the photosensitive drum 41 with laser light, scans, and exposes the photosensitive drum 41 on the basis of the image data.

The development part 44 supplies toner to the photosensitive drum 41 and develops the electrostatic latent image formed on the circumferential surface of the photosensitive drum 41. The cleaning part 46 cleans the photosensitive drum 41. The transfer roller 45 presses against the photosensitive drum 41. The resist-roller pair 33 sends paper into the nip portion between the photosensitive drum 41 and the transfer roller 45 in accordance with the motion of the toner image that was formed. A predetermined transfer voltage is applied to the transfer roller 45. The toner image is thereby transferred to the paper.

The fixing device 5 is positioned further downstream than the image-forming part 4 in the direction of paper conveyance. The fixing device 5 heats, presses, and fixes the toner image transferred to the paper. The fixing device 5 is configured primarily from a heating roller 51, which acts as a rotating heating body and is heated by a heater 50 (see FIG. 3), and a pressing roller 52, which acts as a rotating pressing body and presses against the heating roller. The paper to which the toner image has been transferred is passed through the nip portion between the heating roller 51 and the pressing roller 52 and simultaneously heated and pressed. As a result, the toner image is fixed on the paper. The fixed paper is then conveyed to the second conveying part 3*b* provided above the fixing device 5.

The circumferential surface of the heating roller 51 is shaped as a tubular or a sleeve and is made of aluminum, iron, or another metal. The heater 50 is housed within the heating roller 51. The heater 50 may be configured so as to provide heat to the heating roller 51 by energization. A halogen heater is used as the heater 50 in the printer 100 of the present embodiment. The heater 50 may also use electrically heated wires or induction heating to heat the heating roller 51. The pressing roller 52 has on the circumferential surface an elastic layer that deforms according to the shape of the heating roller 51. The elastic layer is made of a resin such as a silicone sponge.

The paper discharged from the fixing device 5 is conveyed from a branch part 34 through the second conveying part 3*b*, which extends substantially horizontally toward the left surface of the printer 100. The paper is discharged by a discharge-roller pair 35 to a discharge tray 36 provided outside on the upper left surface of the printer 100. The image-forming process is thereby completed. In cases of double-sided printing, once the paper discharged from the fixing device 5 is sent from the branch part 34 in the direction of the discharge tray 36, the conveying direction of the paper is then switched back toward the right surface of the printer 100. The paper is passed through the branch part 34, sent below through a double-sided-printing conveying part 3*c*, and is once again sent through the first conveying part 3*a* to the resist-roller pair 33.

(Hardware Configuration of the Printer 100)

Figure 2:
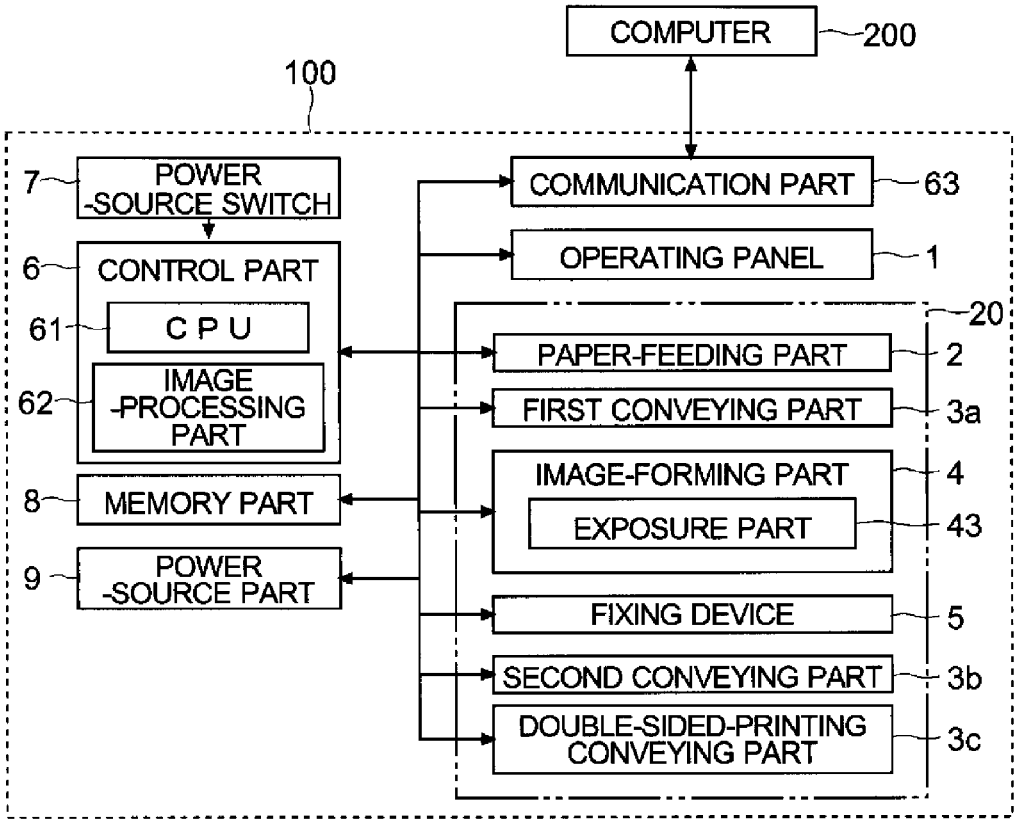
FIG. 2 is a block diagram showing the configuration of the hardware of the printer.

The hardware configuration of the printer 100 according to the embodiment will be described next on the basis of FIG. 2. FIG. 2 is a block diagram showing the hardware configuration of the printer 100.

The printer 100 according to the present embodiment has the control part 6 in the interior, as shown in FIG. 2. The control part 6 includes a CPU 61 for performing various types of calculation and signal processing, an image-processing part 62 for performing image processing on the image data, and the like. The control part 6 causes various types of processes to be performed in the CPU 61 and the image-processing part 62 and controls the parts of the printer 100.

A power-source switch 7 that is operated by the user for turning off the power source (blocking the electric power supply and removing the main power source) or connecting the power source (powering on) to the printer 100 is connected to the control part 6. The power-source switch 7 may be provided to a lateral surface of the printer 100 or may be provided as a hard key to the operating panel 1 or the like. The user pushes the power-source switch 7 when removing the power source of the printer 100. The control part 6 confirms the command to turn off the power source of the printer 100 as implemented using the power-source switch 7. Parts of the control part 6, such as the CPU 61 and the like, are energized even when the power-source switch 7 is "off," and the power source of the printer 100 has been turned off using the power-source switch 7 (described in more detail hereinafter).

The CPU 61 is the central calculating and processing device. The CPU 61 controls the parts of the printer 100 and performs calculations on the basis of uncompressed control programs, control data, setting data, and other information stored in a memory part 8. The memory part 8 is configured from a combination of non-volatile memory such as ROM, flash ROM, or HDD, and volatile memory such as RAM. The memory part 8 stores control programs, control data, and the like for the printer 100. In connection with the present disclosure, when the power-source switch 7 is used to command that the power source of the printer 100 should be turned off, the recorded data that indicates that the power source of the image-forming apparatus has been turned off by the operation of the power-source switch 7 is stored by the control part 6 in the memory part 8 in a non-volatile fashion.

The control part 6 is connected to the operating panel 1 and the like and confirms the settings made using the operating panel 1. The control part 6 causes the liquid-crystal display part 12 of the operating panel 1 to display information about errors, the occurrence of abnormalities, and other states of the printer 100.

The control part 6 is connected to a communication part 63. The communication part 63 is a communication interface for communicating with a computer 200 via a network, cable, or public circuit. The computer 200 is the source for printing data that includes the image data and setting data used for printing. The computer 200 is a personal computer, server, or the like. The communication part 63 receives the printing data from the computer 200.

The image-processing part 62 executes various other types of image processing such as enlargement, reduction, rotation, grey-level transform, and data-format transformation according to the settings, on the image data received from the computer 200. Upon execution of a print job, the image-processing part 62 sends the image-processed image data to the exposure part 43. The exposure part 43 receives the image data and then scans and exposes the photosensitive drum 41.

The control part 6 is communicably connected to an engine part 20 that performs printing and includes the paper-feeding part 2, the first conveying part 3*a*, the image-forming part 4, the fixing device 5, the second conveying part 3*b*, and the double-sided-printing conveying part 3*c*. The control part 6 controls the operation of the engine part 20 and causes printing to be performed. The control part 6 may also be provided in a format partitioned according to function, such as a main control part and an engine-controlling part. The main control part performs overall control, image processing, and communication control, and the engine-controlling part controls the formation of the toner image, the motor for causing the various rotating bodies to rotate, paper conveyance, and printing.

A power-source part 9 is also provided to the printer 100. The power-source part is connected to an external (commercial power source) outlet using a power cord (not shown) and generates a variety of voltages that are necessary for the operation of the printer 100. The control part 6 controls the operation of the power-source part 9. The power-source part 9 will be described in more detail hereinafter.

(Configuration and Control of the Fixing Device 5)

Figure 3:
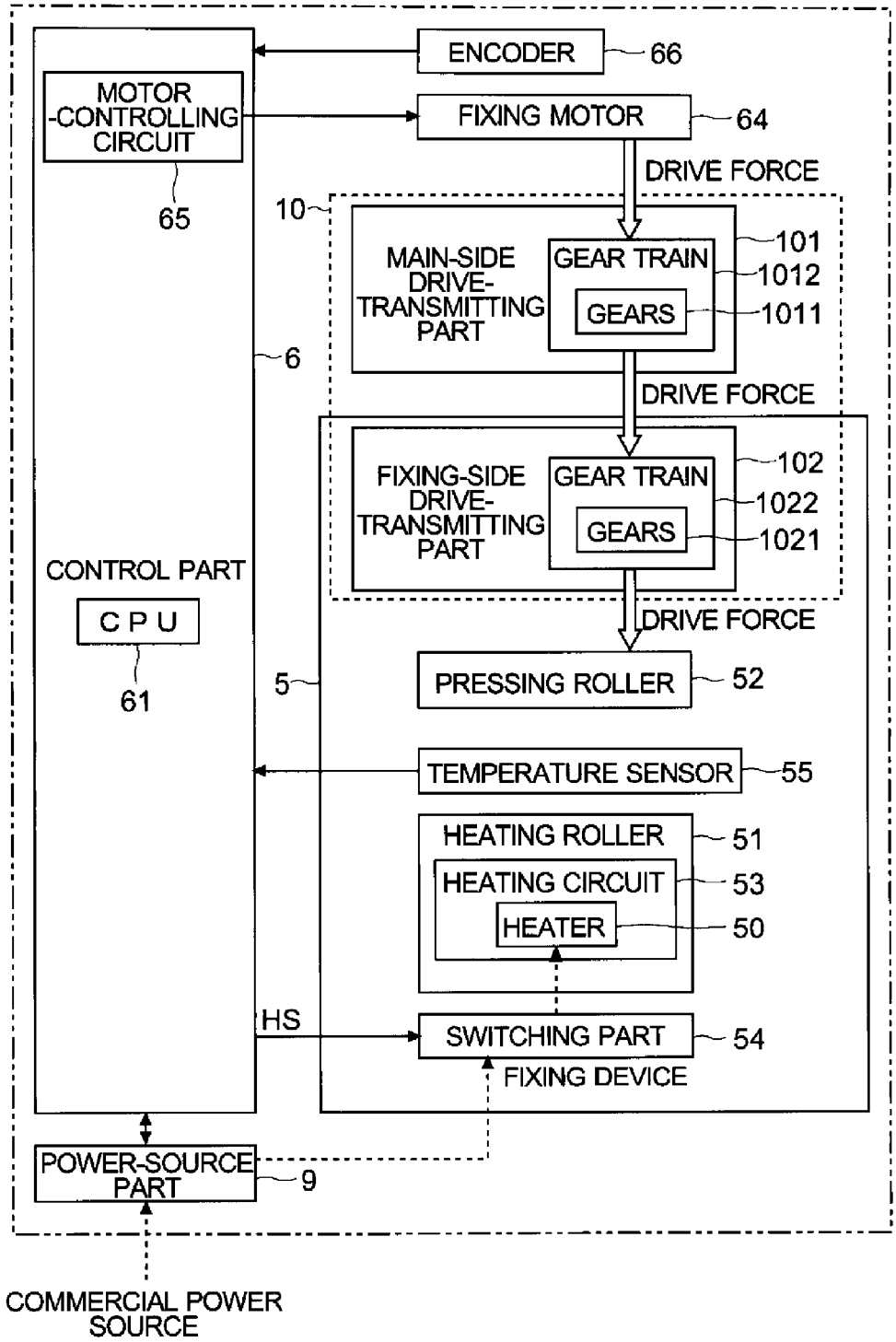
FIG. 3 is a block diagram for describing the configuration and control of the fixing device.

The configuration and control of the fixing device 5 of the printer 100 according to the embodiment will be described next using FIG. 3. FIG. 3 is a block diagram for depicting the configuration and control of the fixing device 5.

A fixing motor 64 and a main-side drive-transmitting part 101 are provided to the main body of the printer 100, as shown in FIG. 3. The fixing motor causes the heating roller 51 and the pressing roller 52 of the fixing device 5 to rotate, and the main drive-transmitting part 101 transmits the drive force of the fixing motor 64.

The fixing motor 64 is the drive source for supplying drive force for causing the heating roller 51 and the pressing roller 52 to rotate within the fixing device 5. The fixing motor 64 is a DC motor. A DC motor need not necessarily be used as the fixing motor 64, and the motor may be a type other than a DC motor. The control part 6 controls the torque and rotational speed of the fixing motor 64. A motor-controlling circuit 65 is provided to the control part 6 as a driver for controlling the torque and rotational speed of the fixing motor 64. The motor-controlling circuit 65 may also be provided to the outside of the control part 6. The motor-controlling circuit 65 adjusts the magnitude and duty ratio of the voltage applied to the fixing motor 64 and the amount of current that flows to the fixing motor 64 to control the torque and rotational speed of the fixing motor 64.

The main-side drive-transmitting part 101 within the main body of the printer 100 includes a gear train 1012 resulting from combining (intermeshing) a plurality of gears 1011. Articles made of resin are used as the gears 1011.

The fixing device 5 is a unitized. The heating roller 51, a heating circuit 53, a switching part 54, a temperature sensor 55, the pressing roller 52, a fixing-side drive-transmitting part 102, and the like are included in the unit of the fixing device 5, as shown in FIG. 3.

The heater 50 for heating the heating roller 51 is provided to the fixing device 5. The heating circuit 53 is provided to the fixing device 5 for energizing the heater 50. The switching part 54 is, e.g., a triac and switches on and off the power source of the heater 50. The switching part is connected to the heating circuit 53.

The control part 6 also controls the fixing device 5, as shown in FIG. 3. A heater-control signal line HS is connected from the control part 6 to the switching part 54. The control part 6 (CPU 61) uses the heater-control signal line HS to input to the switching part 54 a heater-drive-control signal, which directs the on/off control relating to energizing the heater 50. The on/off control relating to energizing the heater 50 and output control of the heater 50 is thereby accomplished.

The temperature sensor 55 for measuring the temperature of the heating roller 51 positioned within the fixing device 5 is provided within the printer 100. The output voltage of the temperature sensor 55 is inputted to the control part 6. The temperature sensor 55 includes a thermistor that (optionally) contacts the heating roller 51. The resistance value of the thermistor changes according to temperature, and therefore the output voltage of the temperature sensor 55 changes according to the temperature of the heating roller 51. The control part 6 performs A/D conversion on the output voltage of the temperature sensor 55 and confirms the temperature of the heating roller 51 (the fixing device 5) using the magnitude of the output voltage.

The memory part 8 stores a data table that gives the correspondence relationship between the magnitude of the output voltage of the temperature sensor 55 and the temperature of the heating roller 51. The control part 6 makes reference to the data table of the memory part 8 and confirms the temperature of the heating roller 51 on the basis of the output voltage of the temperature sensor 55. The control part 6 then confirms the current temperature of the fixing device 5 (the heating roller 51). After the main power source is turned on, the control part 6 uses the heater-drive-control signal to control the energizing of the heater 50, except in cases where a transition has been made to a power-conserving mode such as sleep mode, and the temperature of the fixing device 5 has been held at a low level. The control part 6 performs temperature control so that the temperature of the heating roller 51 is maintained at a fixing control temperature, including those times when a printing job is executed. The "fixing control temperature" is the temperature of the heating roller 51 to be maintained during printing and is applied when fixing the toner image (the value of the fixing control temperature is, e.g., 180° C. but varies depending on the specifications). The fixing control temperature is set for each model of the image-forming apparatus according to experiments and the like performed in advance, while taking into account the melting characteristics of the toner, the material from which the heating roller 51 and the pressing roller 52 are made, and other considerations.

There follows an outline of feedback control for maintaining the fixing control temperature. When the temperature of the heating roller 51 is lower than the fixing control temperature when the main power source is connected, the control part 6 energizes the heater 50 and heats the heating roller 51. When the control part 6 thereafter confirms from the output voltage of the temperature sensor 55 that the temperature of the heating roller 51 is higher than the fixing control temperature, a command is given to turn off the energizing of the heater 50. When the temperature of the heating roller 51 is thereafter confirmed to be lower than the fixing control temperature, the control part 6 sends a signal to the switching part 54 directing that energization of the heater 50 be turned on. The control part 6 thus repeatedly uses the switching part 54 to turn energization of the heater 50 on and off The control part 6 may also increase or decrease the duty ratio of energization of the heater 50 to control the output of the heater 50 according to the difference between the fixing control temperature and the current temperature of the heating roller 51.

The power-source part 9 is provided so as to be connected to an external (commercial power source) outlet by using power cord and to generate a variety of voltages that are necessary for the operation of the image-forming apparatus within the image-forming apparatus. Electric power from a commercial power source is inputted to the power-source part 9 as shown by the dashed line in FIG. 3. The power-source part 9 is connected to the switching part 54 of the fixing device 5. When switching part 54 is in an "on" state, the commercial power source is connected through the power-source part 9 to the heater 50 of the fixing device 5. Electric power is thereby supplied to the heater 50. The power-source part 9 also generates voltage for the control part 6 and for driving the motors (described in more detail hereinafter).

The fixing-side drive-transmitting part 102 for transmitting drive force to the fixing motor 64 is provided to the fixing device 5. The fixing-side drive-transmitting part 102 includes a gear train 1022 resulting from combining (intermeshing) a plurality of gears 1021. Articles made of resin are used as the gears 1021. One of the gears 1021 in the gear train 1022 is connected to the pressing roller 52 (the gears may also be connected to the heating roller 51). The fixing device 5 is attached to the printer 100 so that one of the gears 1021 in the gear train 1022 of the fixing-side drive-transmitting part 102 is intermeshed with one of the gears 1011 of the main-side drive-transmitting part 101. The fixing motor 64 is thereby made to rotate, whereby drive force is transmitted through the main-side drive-transmitting part 101 and the fixing-side drive-transmitting part 102, and the pressing roller 52 rotates. The heating roller 51 that presses against the pressing roller 52 also rotates according to the rotation of the pressing roller 52. A drive-transmitting part 10 that uses the fixing motor 64 to cause the heating roller 51 and the pressing roller 52 to rotate is thus a combination of the fixing-side drive-transmitting part 102 and the main-side drive-transmitting part 101.

An encoder 66 that acts as a rotation detector for detecting whether or not the fixing motor 64 is rotating and for detecting the rotational speed of the fixing motor 64 is provided to the fixing device 5. The encoder 66 is mounted on the fixing motor 64. The encoder 66 may also be provided to the heating roller 51 or the pressing roller 52. The encoder 66 is attached to the drive shaft of the fixing motor 64 and includes a rotating plate, which is provided with a plurality of apertures, and a transmissive optical sensor that sandwiches the rotating plate. The apertures are provided at set angles. The output of the encoder 66 changes when the encoder 66 detects or does not detect an aperture. The period of the changes in the output of the encoder 66 therefore changes according to the rotational speed of the rotating plate (the fixing motor 64).

The output of the encoder 66 is inputted to the control part 6. The control part 6 can confirm whether or not the fixing motor 64, the heating roller 51, and the pressing roller 52 are rotating on the basis of whether or not the output of the encoder 66 is changing. The CPU 61 calculates the period and frequency of the changes in the output of the encoder 66, whereby the control part 6 can confirm the rotational speed of the fixing motor 64 on the basis of the period and frequency. The gear ratios and the like are fixed, and therefore the control part 6 can also determine the rotational speed (circumferential speed) of the heating roller 51 and the pressing roller 52 on the basis of the rotational speed of the fixing motor 64.

(Details of the Power-Source Part 9)

Figure 4:
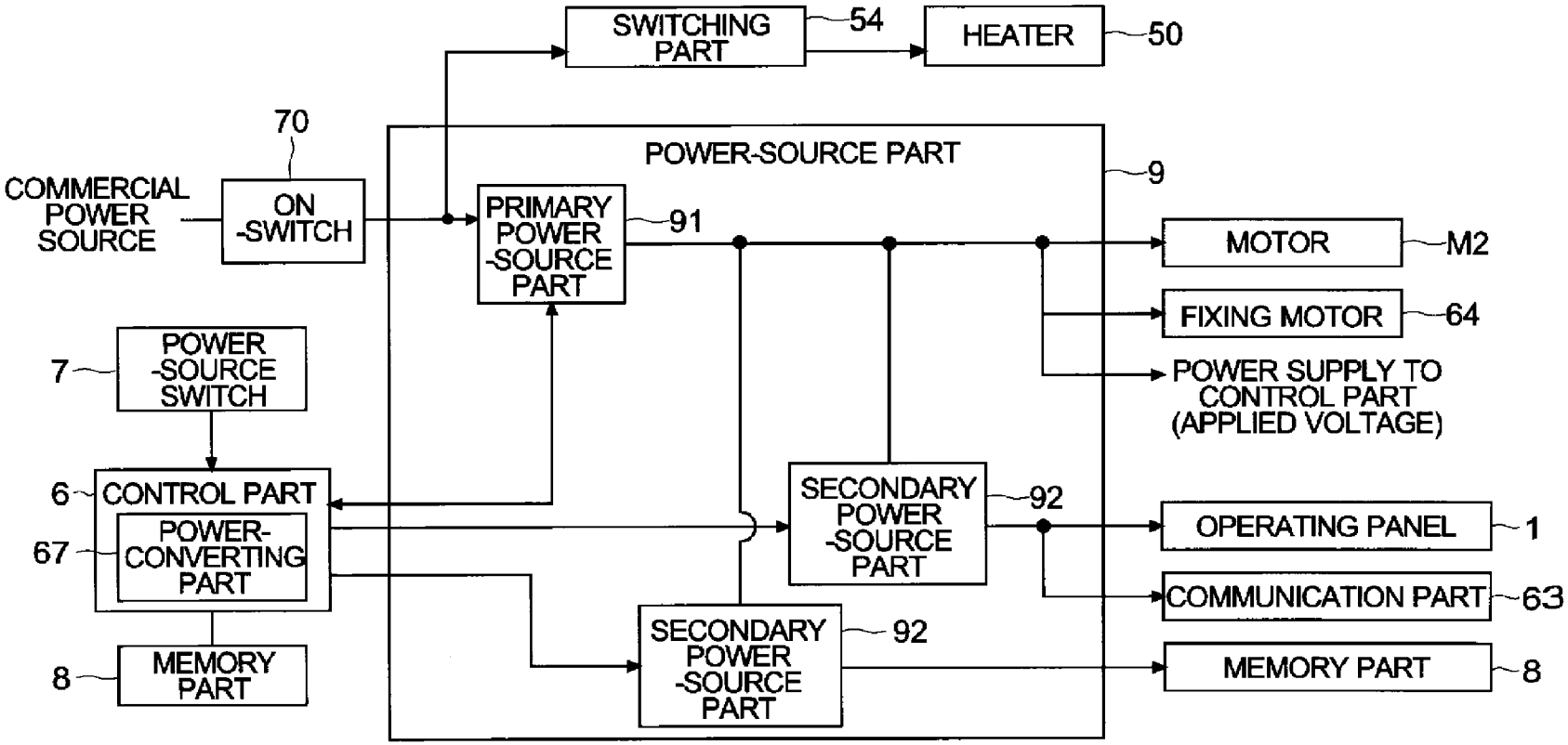
FIG. 4 is a block diagram showing the configuration and power-supply relationships of the power-source part.

Electric power supply in the printer 100 according to the embodiment will be described next using FIG. 4. FIG. 4 is a block diagram showing the configuration and power-supply relationships of the power-source part 9.

The configuration of the power-source part 9 will be described first. The power-source part 9 is connected to a commercial power source (outlet) by using a power cord or the like. Electric power is thereby inputted from the commercial power source to the power-source part 9. In other words, electric power is supplied from the commercial power source to the printer 100. The power-source part 9 includes a primary power-source part 91.

The primary power-source part 91 is a power-converting circuit that acts as a converter having rectifier circuit, a smoothing circuit, and the like for rectifying the alternating current supplied from the commercial power source to direct current. The primary power-source part 91 includes a full-wave rectifier circuit that has a diode bridge, a coil, a capacitor, for smoothing, and the like.

The primary power-source part 91 outputs a direct-current voltage (DC 24 V) for the fixing motor 64 and, besides the fixing motor 64, the motors M2. A motor for causing rotation of the various types of rotating bodies, such as the photosensitive drum 41 of the image-forming part 4, a motor for paper conveyance, a motor for causing rotation of the paper-feeding roller 22, and the like may be used as the motors M2 provided to the interior of the printer 100. For the sake of convenience, only one motor M2 other than the fixing motor 64 is shown in FIG. 4.

The primary power-source part 91 outputs direct-current voltage to the control part 6. A voltage of DC 24 V is [too] large for the circuits and elements included in the control part 6, which includes the CPU 61 and the like, and for the various memory devices of the memory part 8 and the circuits of the communication part 63, and therefore a power-converting part 67 that acts as a power-converter circuit for generating the voltage necessary to drive the control part 6 is provided to the control part 6. A secondary power-source part 92 for receiving the output of the primary power-source part 91 and generating voltage for the control part 6 may also be provided outside the control part 6 to supply electric power to the control part 6.

The secondary power-source parts 92 are provided as necessary for generating voltages on the basis of the output of the primary power-source part 91 as necessary for the operation of the various parts included in the printer 100 (two are shown in FIG. 4 as an example). The secondary power-source part 92 is a DC-DC converter or a regulator. One of the secondary power-source parts 92 can be provided for generating driving voltage (DC 5 V) for the operating panel 1 and the communication part 63, and one of the secondary power-source parts 92 can be provided for generating driving voltage (DC 3.3 V) for driving the memory part 8. Two or more of the secondary power-source parts 92 may also be provided according to the types of voltage required.

The control part 6 is connected to each of the secondary power-source parts 92 and controls the operation of the secondary power-source parts 92, as shown in FIG. 4. When the power-source switch 7 is pushed, the control part 6 can stop the driving of the secondary power-source parts 92 for generating driving voltage for the operating panel 1 and the memory part 8 and turn the power source of the printer 100 off.

(Turning the Power Source off Using the Power-Source Switch 7)

Figure 5:
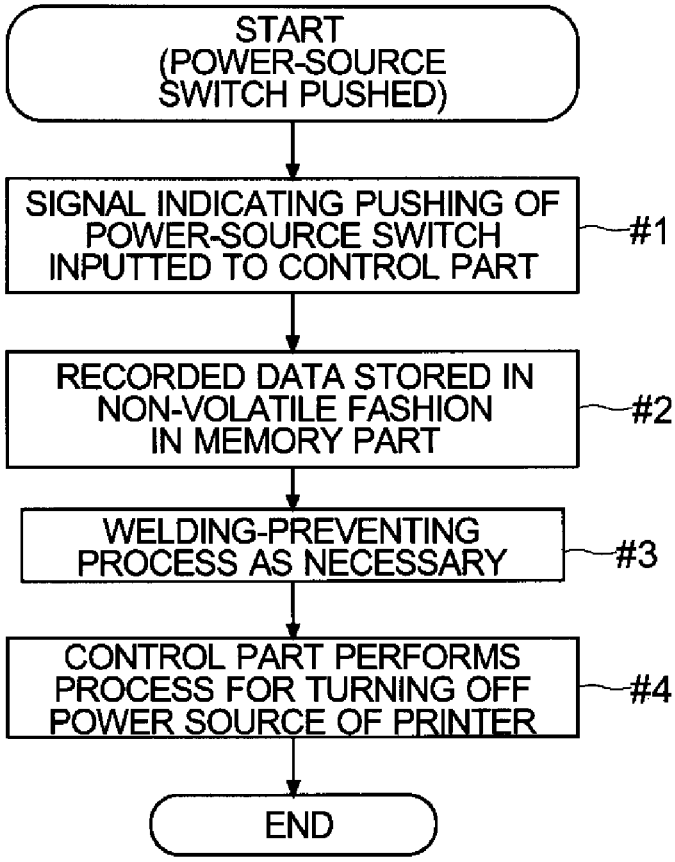
FIG. 5 is a flowchart showing the process flow when the power source of the printer is turned off on the basis of operation of the power-source switch.

The process flow when the power source is turned off using the power-source switch 7 in the printer 100 of the present embodiment will be described next using FIGS. 4 and 5. FIG. 5 is a flow chart showing the process flow when the power source of the printer 100 is turned off on the basis of operation of the power-source switch 7.

The power-source switch 7 is provided to the printer 100, as shown in FIGS. 2 and 4, and as described above. The control part 6 is connected to the power-source switch 7. A signal indicating that the power-source switch 7 has been pushed is inputted to the control part 6. The signal from the power-source switch 7 causes the control part 6 to confirm that the power-source switch 7 has been operated by the user in order to turn off the power source of the printer 100. In other words, the power-source switch 7 causes the control part 6 to confirm a command to turn off the power source of the image-forming apparatus.

In the printer 100 of the present embodiment, when the power-source switch 7 is pushed while the power source of the printer 100 is connected, data (recorded data) indicating that the power source of the printer 100 has been turned off due to operation of the power-source switch 7 is stored in the memory part 8 in a non-volatile fashion. Electric power supply to the various parts is then stopped, and the power source of the printer 100 is turned off. In other words, the recorded data is stored in the memory part 8, and therefore the power source of the printer 100 is not turned off immediately even when the power-source switch 7 is pushed.

The process flow when the power-source switch 7 is pushed will accordingly be described using FIG. 5. The start in FIG. 5 is the time point at which the power-source switch 7 is pushed in a state in which the power source of the printer 100 is connected.

When the power-source switch 7 is pushed, a signal indicating that the power-source switch 7 has been pushed is inputted to the control part 6 (Step #1). The control part 6 that has received this signal stores in the memory part 8 recorded data indicating that the power-source switch 7 has been pushed, whereby the power source of the printer 100 has been turned off (Step #2). The recorded data is thus stored in the memory part 8, except in cases where the electric power supply to the printer 100 is suddenly blocked.

When the power-source switch 7 is pushed during printing or another state in which the heating roller 51 is heated by the heater 50, the control part 6 may stop the supply of electric power to (block energization of) the heater 50 once the printing job has completed and perform processes for causing the heating roller 51 to cease to be heated by the heater 50. Alternatively, the fixing motor 64 may continue to be made to rotate after the supply of electric power to (energize) the heater 50 has been stopped, and processes may be performed on the basis of the output of the temperature sensor 55 to reduce the temperature of the heating roller 51 to a temperature that is determined in advance and at which welding will not occur. Thus, when the power-source switch 7 is pushed, the control part 6 may completely block energization of the heater 50 through the power-source part 9 and the switching part 54, and may perform a welding-preventing process for reducing the temperature of the heating roller 51 (Step #3). The welding-preventing process need not be performed when the temperature of the heating roller 51 is less than or equal to the fixing control temperature.

When the recorded data has finished being stored by the memory part 8, the control part 6 performs a process for controlling the power-source part 9 and turns off the power source of the printer 100 (power-source-turning off process) (Step #4). The control part 6, e.g., stops the secondary power-source part 92 that supplies electric power to the memory part 8. The control part 6 thereafter stops the secondary power-source part 92 that supplies electric power to parts other than the memory part 8, such as the operating panel 1. The control part 6 also holds the switching part 54 in the "off" state (holds a state in which energization of the heater is blocked). The primary power-source part 91 is held in a driven (operating) state without being stopped, even when the power-source switch 7 is pushed. In other words, the primary power-source part 91 operates as long as the printer 100 and commercial power source are connected by using the power cord. Cases where the primary power-source part 91 is completely stopped therefore occur when the power cord is pulled out of the outlet.

In a state when the commercial power source and the printer 100 are connected by using the power cord, and the primary power-source part 91 is operating, electric power is supplied to the control part 6, and the control part 6 (the CPU 61 and the like) continues to maintain functionality while partially stopping unnecessary functions and conserving electric power. The power source is thus turned off in the printer 100 according to the power-source switch 7 having been pushed (End).

(Process for Powering-on the Printer 100)

Figure 6:
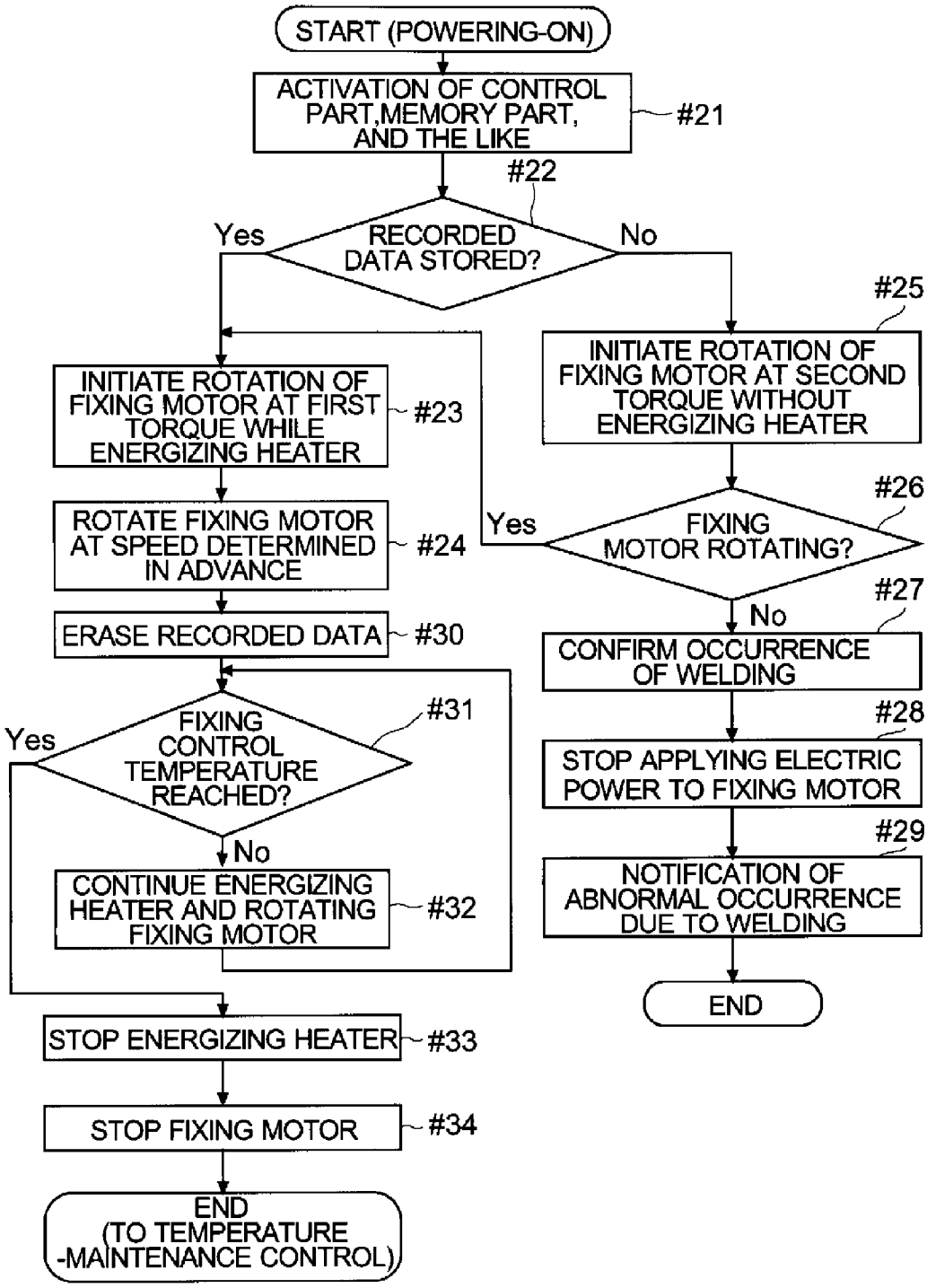

The process flow for powering on (connecting the main power source) of the printer 100 according to the present embodiment will be described next using FIG. 6. FIG. 6 is a flow chart showing the warm-up process flow in the fixing device 5 when the printer 100 has been powered on.

The printer 100 cannot be used (cannot print) in a state where the power source of the printer 100 is turned off. To use the printer 100, the power source of the printer 100 must be connected, electric power must be supplied to the parts within the printer 100, the parts must be activated and warmed-up, and the printer 100 must be put in a usable state.

The power-source switch 7 is pushed to connect the power source of the printer 100. The primary power-source part 91 and the control part 6 (CPU 61) are in operation as long as the power cord is not pulled out, even in states where the power source of the printer 100 has been turned off by the power-source switch 7. The power-source switch 7 is pushed, and a signal indicating that the power-source switch 7 has been pushed is inputted to the control part 6. This signal input causes the control part 6 to initiate the output of voltage from the secondary power-source parts 92. Electric power thereby returns to the memory part 8 and the other parts within the printer 100, the control part 6 and the memory part 8 are fully activated, and warm-up is initiated.

A power-on switch 70 for turning electric power on and connecting the commercial power source and the primary power-source part 91 when pushed may also be provided to the printer 100, separately from the power-source switch 7 (see FIG. 4). In such cases, the power-on switch 70 is pressed, the primary power-source part 91 initiates driving (generates voltage), and the control part 6 initiates operation. When the power-source switch 7 is then pushed, the printer 100 can be powered on in the same manner as described above, and warm-up is initiated. In other words, in cases where the power-on switch 70 is provided, the order of operations is such that the power-source switch 7 is pushed after the power-on switch 70 has been turned to "on."

The activation of the memory part 8 and the like causes the control part 6 to read the warm-up programs from the memory part 8 and initiate the warm-up process for allowing the printer 100 to be used. In the warm-up process, the control part 6 implements a control so that the heater 50 of the fixing device 5 is energized, the temperature of the heating roller 51 is raised to the fixing control temperature, and the toner image can be fixed.

Depending on the conditions of the previous instance in which the power source of the printer 100 was turned off, the pressing roller 52 may be partially melted, and welding, in which the melted portions adhere to the heating roller 51, may have occurred. The possibility of welding exists when the electric power supply to the printer 100 is suddenly blocked, and the power source is thereby turned off due to the power cord being erroneously pulled out, electric power outages, the occurrence of abnormalities in the power-source part 9, or for other reasons.

When the supply of electric power to the printer 100 is suddenly blocked, the heating roller 51 and the pressing roller 52 stop rotating. A state in which the heating roller 51 is heated by the heater 50 is a state in which the heater 50 and the heating roller 51 have much thermal energy. When the heating roller 51 and the like stop rotating in this state, heat is transferred from the heating roller 51 only to the portions of the pressing roller 52 in contact with the heating roller 51. When heat is transferred from the heating roller 51 and concentrates only in a portion of the pressing roller 52, the portions on the circumferential surface of the pressing roller 52 that are in contact with the heating roller 51 melt, and welding may occur. The heating roller 51 and the pressing roller 52 cannot rotate when welding occurs.

In cases where welding occurs, when rotation of the fixing motor 64 is initiated as in normal warm-up, a large force (torque) acts on the gears included in the drive-transmitting part 10. Teeth and other parts of the gear may then break. Additionally, a large current continuously flows to the fixing motor 64 when the fixing motor 64 is held in the "on" state despite the occurrence of welding. The fixing motor 64 will then break. Accordingly, in the printer 100 according to the present embodiment, in cases where the possibility exists that welding has occurred, the control part 6 initiates rotation of the fixing motor 64 using a smaller torque than that normally used during warm-up.

The warm-up process flow in the fixing device 5 upon powering-on will accordingly be described using FIG. 6.

The start in FIG. 6 is the time point at which the power-source switch 7 is pushed in a state in which the printer 100 is connected to the commercial power source by using the power cord, and the printer 100 has been powered on. Powering on causes the initiation of the generation of the various types of voltage in the power-source part 9, the initiation of the supply of electric power to the memory part 8 and the like, and the activation of the control part 6, the memory part 8, and the like (an activation process is performed, Step #21).

The control part 6 next confirms whether or not the power source was turned off in the printer 100 using the power-source switch 7 in the previous instance. In other words, the control part 6 confirms whether or not the recorded data is stored in the memory part 8 (Step #22).

When the recorded data is stored in the memory part 8 ("Yes" in Step #22), welding has not occurred, and the drive-transmitting part 10 will not break, even when a large torque is produced in the fixing motor 64. The control part 6 accordingly initiates the rotation of the fixing motor 64 at a first torque (normal starting torque) while energizing the heater 50 (Step #23). In other words, the control part 6 applies electric power to the fixing motor 64 so as to initiate rotation of the fixing motor 64 at the first torque. The control part 6 then causes the fixing motor 64 to rotate so that the rotational speed of the heating roller 51 is normal (Step #24). The control part 6 thus causes the fixing motor 64 to rotate and performs warm-up in the normal fashion when the recorded data is stored in the memory part 8.

Specifically, when the recorded data is present, when initiating the rotation of the fixing motor 64, the control part 6 applies a voltage for normal warm-up (the maximal voltage that can be applied, the output voltage value of the primary power-source part 91) to the fixing motor 64 and initiates rotation of the fixing motor 64 at the first torque, which is the maximum torque that can be outputted (Step #23). The control part 6 then causes the fixing motor 64 to rotate at a speed determined in advance while confirming the output of the encoder 66. In other words, the control part 6 adjusts the magnitude of the voltage applied to the fixing motor 64, adjusts the duty ratio to control the rotational speed of the fixing motor 64 so that the rotational speed of the fixing motor 64 is the normal rotational speed determined in the specifications in advance. The circumferential speed of the heating roller 51 and the pressing roller 52 thereby also reaches a speed determined in advance.

When the recorded data is not stored in the memory part 8 ("No" in Step #22), the possibility exists that welding has occurred, and gears in the drive-transmitting part 10 may break when a large torque (the first torque) is produced by the fixing motor 64.

The control part 6 accordingly initiates rotation of the fixing motor 64 at a second torque, which is smaller than the first torque and is a starting torque for detecting welding, without energizing the heater 50 (Step #25). In other words, the control part 6 applies electric power to the fixing motor 64 so that rotation of the fixing motor 64 is initiated at the second torque. Specifically, when the recorded data is not present, the control part 6 initiates rotation of the fixing motor 64 using a voltage that is smaller than the voltage for the producing the normal first torque as the voltage to be applied to the fixing motor 64. Alternatively, the control part 6 adjusts the duty ratio at a set voltage to be applied to the fixing motor 64, reduces the electric power given to the fixing motor 64 to below the level used when producing the first torque, and initiates rotation of the fixing motor 64 at the second torque.

Specifically, when the recorded data is not present, the control part 6 uses the fixing motor 64 to generate the minimal torque that can initiate rotation of the rollers (the second torque). The gears within the drive-transmitting part 10 can thereby be prevented from breaking, even when welding has occurred.

The magnitude, duty ratio, and other characteristics of the voltage to be applied to the fixing motor 64 when producing the minimal torque may be measured in advance, and the conditions for applying voltage to the fixing motor 64 for producing the minimal torque may be stored in the memory part 8. While confirming the output of the encoder 66, the control part 6 increases the voltage applied to the fixing motor 64 in stages, increases the duty ratio, and stores in the memory part 8 the voltage application conditions at which rotation of the fixing motor 64 was initiated as the conditions for generating the second torque. When the recorded data is not present, the control part 6 applies electric power to the fixing motor 64 for initiating rotation of the fixing motor 64 on the basis of the conditions for generating the second torque as stored in the memory part 8.

The control part 6 confirms whether or not the fixing motor 64 is rotating on the basis of the output of the encoder 66 (Step #26). When the fixing motor 64 has not rotated even after the passage of a set amount of time ("No" in Step #26), the control part 6 confirms that welding has occurred in the fixing device 5 (Step #27).

Continuing to drive the fixing motor 64 and to apply torque (load) to the drive-transmitting part 10 despite the occurrence of welding is not preferable. Accordingly, when the control part 6 can detect that the fixing motor 64 is not rotating, the control part stops applying electric power to the fixing motor 64 (Step #28). When welding has occurred in the fixing device 5, printing cannot be performed, and the fixing device 5 must be replaced. The control part 6 accordingly directs a display on the liquid-crystal display part 12 of the operating panel 1 and makes a notification of the occurrence of an abnormality due to welding (Step #29). The present flow is then finished. The fixing device 5 is thereafter repaired by service personnel or the like replacing the fixing device for another unit.

Even when the recorded data is not present, when the fixing motor 64 rotates ("Yes" in Step #26), the flow may move to Step #23. Thus, when the control part 6 detects that the fixing motor 64 is rotating, the fixing motor 64 is made to rotate at the first torque, and warm-up is initiated in the normal fashion.

According to Step #24, the control part 6 confirms that welding has not occurred when the fixing motor 64 can be made to rotate so that the rotational speed of the heating roller 51 is normal. The control part 6 accordingly erases (deletes) the recorded data from the memory part 8 (Step #30). The presence or absence of the recorded data in the memory part 8 is thereby confirmed when the memory part 8 is activated as a result of powering-on, whereby it can be confirmed whether or not the previous blockage of the supply of electric power in the printer 100 was made by the power-source switch 7.

The control part 6 monitors the output of the temperature sensor 55 and confirms whether or not the temperature of the heating roller 51 has reached the fixing control temperature (Step #31). When the temperature of the heating roller 51 has not reached the fixing control temperature ("No" in Step #31), the control part 6 continues energizing the heater 50 and causing the fixing motor 64 to rotate (Step #32), and once again confirms [whether or not] the fixing control temperature has been reached (the flow returns to Step #31).

When the temperature of the heating roller 51 has reached the fixing control temperature ("Yes" in Step #31), the control part 6 stops energizing the heater 50 (Step #33) and, when a set period of time has passed, stops the fixing motor 64 (Step #34). The present flow is then finished, and the control part 6 transitions to control for maintaining the fixing control temperature of the heating roller 51 until a transition to electric power-saving mode or the like is made, and maintaining the fixing control temperature is not necessary (End).

When the supply of electric power to the image-forming apparatus (printer 100) is suddenly blocked, the supply of electric power to the memory part 8 is also suddenly stopped. The memory part 8 therefore stops operating without being able to store the recorded data indicating that the power source of the image-forming apparatus has been turned off. Meanwhile, when the electric power supply to the image-forming apparatus is suddenly blocked, the rotating heating body (the heating roller 51) and the like may suddenly stop rotating in a state in which the heater 50 is energized and the temperature of the rotating heating body (the heating roller 51) is high, and welding may occur.

The image-forming apparatus (the printer 100) according to the present embodiment accordingly includes the power-source part 9, the fixing device 5, the power-source switch 7, the memory part 8, the fixing motor 64, and the drive-transmitting part 10. The power-source part 9 connects to an external power source (a commercial power source), and generates and supplies voltage necessary for the operation of the image-forming apparatus. The fixing device 5 includes the rotating heating body (the heating roller 51), the heater 50 by using energization to heat the rotating heating body, and the rotating pressing body (the pressing roller 52), which has an elastic layer, presses against the rotating heating body to form forms a nip portion. The fixing device passes paper through the nip portion and performs fixation, a toner image having been transferred to the paper. The power-source switch 7 is a switch for turning off the power source of the image-forming apparatus. The memory part 8 stores recorded data for indicating that the power source of the image-forming apparatus was turned off due to the operation of the power-source switch 7. Upon activation of the memory part 8 due to powering-on of the image-forming apparatus, when the recorded data concerning a previous instance of the power source of the image-forming apparatus being turned off is stored in the memory part 8, electric power is applied to the fixing motor 64 so as to initiate rotation at the first torque, and when the recorded data is not stored in the memory part 8, electric power is applied to the fixing motor so as to initiate rotation at the second torque, which is less than the first torque, and the rotating heating body and the rotating pressing body are made to rotate. The drive-transmitting part 10 includes a plurality of gears (the gears 1011 and the gears 1021), transmits the drive force of the fixing motor 64 to one or both of the rotating pressing body and the rotating heating body, and causes the rotating pressing body and the rotating heating body to rotate.

In cases where welding has occurred, the fixing motor 64 cannot be made to rotate. Electric power must therefore be applied to the fixing motor 64 so that a more limited torque (the second torque) than the normal torque (the first torque) of the fixing motor 64 is used when the possibility exists that welding has occurred in the image-forming apparatus (the printer 100) of the present embodiment. The force acting on the gears (the gears 1011 and the gears 1021) included in the drive-transmitting part 10 can therefore be limited, and the gears included in the drive-transmitting part 10 can be prevented from breaking, even when welding has occurred. Since the torque of the fixing motor 64 is limited more than normal, the continuous flow of large amounts of current to the fixing motor 64 can be avoided, and the fixing motor 64 can be prevented from breaking down, even when welding has occurred. The cascade of damage resulting from the occurrence of welding can thus be stopped.

The image-forming apparatus (the printer 100) includes a rotation detector (the encoder 66) that is for detecting whether or not the fixing motor 64 is rotating. When it is detected (recognized) that the fixing motor 64 is not rotating during application of the second-torque, the application of electric power to the fixing motor 64 is stopped. When it is detected (recognized) that the fixing motor 64 is rotating during application of the second-torque, the fixing motor 64 is made to increase the rotational speed until reaching the normal rotational speed, which is determined in advance. The occurrence of welding can thereby be detected on the basis of the fact that the fixing motor 64 does not rotate. When the occurrence of welding has been detected, the fixing motor 64 is stopped, and force can be stopped from continuing to act on the gears (the gears 1011 and the gears 1021) included in the drive-transmitting part 10.

The image-forming apparatus (the printer 100) includes the control part 6, which is connected to the power-source switch 7, confirms(recognizes) the command to turn off the power source of the image-forming apparatus due as made using the power-source switch 7 and controls the operation of the power-source part 9. The power-source part 9 includes the primary power-source part 91 and the secondary power-source parts 92 that receive voltage generated by the primary power-source part 91 and generate other voltages. The memory part 8 receives a supply of electric power from the secondary power-source parts 92. When the control part 6 confirms(recognizes) a command to turn off the power source of the image-forming apparatus by using the power-source switch 7, the recorded data is stored in the memory part 8. After recording, the operation of the secondary power-source part 92 for supplying electric power to the memory part 8 is stopped. When the power-source switch 7 is used to turn off the power source of the image-forming apparatus, the recorded data that indicates that the blockage of the supply of electric power to the image-forming apparatus was due to the operation of the power-source switch 7 is thereby reliably stored in the memory part 8, after which the electric power supply to the memory part 8 and the like can be stopped.

The fixing motor 64 makes to rotate using the second torque, which is the minimum torque capable of causing the rotating heating body (the heating roller 51) and the rotating pressing body (the pressing roller 52) to rotate in the absence of welding. When the possibility exists that welding has occurred, electric power is thereby applied to the fixing motor 64 so that the torque of the fixing motor 64 is the minimum necessary. The torque of the fixing motor 64 is therefore limited to a degree such that broken teeth will not occur in the gears (the gears 1011 and the gears 1021) of the drive-transmitting part 10, even when welding has occurred.

The image-forming apparatus (the printer 100) includes a notification part (the operating panel 1) for making notifications of abnormal occurrences in the fixing device 5 when it is detected (recognized) that the fixing motor 64 is not rotating during application of the second-torque by using the rotation detector (the encoder 66), and electric power has stopped being applied to the fixing motor 64. The user can thereby be notified of abnormalities in the fixing device 5 resulting from welding and the like, and of the necessity of replacing the fixing device 5.

The fixing device 5 is a unitized. The drive-transmitting part 10 is connected to the fixing motor 64 and is configured from the main-side drive-transmitting part 101 and the fixing-side drive-transmitting part 102. The main-side drive-transmitting part 101 includes the gears (the gears 1011) provided to the main body of the image-forming apparatus (the printer 100), and the fixing-side drive-transmitting part 102 includes the gears (the gears 1021) for causing the rotating pressing body (the pressing roller 52) and the rotating heating body (the heating roller 51) provided to the fixing device 5 to rotate. The fixing device 5 is attached to the image-forming apparatus, whereby the gear of the main-side drive-transmitting part 101 and the gear of the fixing-side drive-transmitting part 102 intermesh, and the rotating heating body and the rotating pressing body are thereby made to rotate due to the drive force of the fixing motor 64. Repairs can thereby be completed by replacing the fixing device 5, even when welding has occurred in the fixing device 5. Breaking of the teeth or other parts of the gears of the main-side drive-transmitting part 101, which is inside the image-forming apparatus and is therefore more difficult to repair or replace than the fixing device 5, can be prevented. Therefore, the cascade of damage caused by the occurrence of welding can be stopped, and the need for complex repairs can be prevented.

After the fixing motor 64 has initiated rotation using the first torque or the second torque, the memory part 8 deletes the recorded data once the rotational speed of the fixing motor 64 reaches the normal rotational speed, which is determined in advance. The recorded data is thereby deleted each time a clear determination has been made that welding has not occurred. The recorded data stored in the memory part therefore indicates that the power-source switch 7 was used to turn off the power source of the image-forming apparatus (the printer 100) in the previous instance. The recorded data does not accumulate, and the space required to store the recorded data can be limited.

When the power-source switch 7 is pushed, the power-source part 9 blocks energization of the heater 50, the fixing motor 64 causes the rotating heating body (the heating roller 51) to rotate and reduces the temperature, and a welding-preventing process is performed. A process for preventing welding is thereby implemented even when the power-source switch 7 is pushed and the power source in the image-forming apparatus (the printer 100) is turned off Welding therefore occurs less readily.

The present disclosure can also be taken as a method disclosure.

The foregoing is a description of an embodiment of the present disclosure, but the scope of the present disclosure is not limited thereto, but rather a variety of modifications can be additionally carried out within a scope that does not depart from the spirit of the disclosure.

What is claimed is:

1. An image-forming apparatus, comprising:

a power-source part configured to generate and supply a voltage necessary for the operation of the image-forming apparatus, and to be connected to an external power source;

a fixing device configured to have a rotating heating body, a heater configured to use energization to heat the rotating heating body, and a rotating pressing body having an elastic layer and configured to press against the rotating heating body to form a nip portion, the fixing device configured to allow paper to pass through the nip portion and performing fixation, a toner image having been transferred to the paper;

a power-source switch configured to turn off the power source of the image-forming apparatus;

a memory part configured to store recorded data indicating that the power source of the image-forming apparatus was turned off due to operation of the power-source switch;

a fixing motor configured to cause the rotating heating body and the rotating pressing body to rotate when the memory part is activated due to powering-on of the image-forming apparatus, to be applied electric power for initiating rotation at a first torque when the memory part stores the recorded data concerning a previous instance of the power source of the image-forming apparatus being turned off, and to be applied electric power for initiating rotation at a second torque when the recorded data is absent from the memory part, the second torque being less than the first torque; and a drive-transmitting part configured to have a plurality of gears to transmit drive force of the fixing motor to one or both of the rotating pressing body, and to cause the rotating heating body and the rotating pressing body and the rotating heating body to rotate.

2. The image-forming apparatus according to claim 1, further comprising:

a rotation detector that is for detecting whether the fixing motor is rotating, wherein the application of electric power to the fixing motor is stopped when the rotation of the fixing motor is not detected in during application of the second torque, and the fixing motor is made to increase the rotational speed to a normal rotational speed when the rotation of the fixing motor is detected in during application of the second torque, the normal rotational speed being determined in advance.

3. The image-forming apparatus according to claim 1, further comprising:

a control part that is connected to the power-source switch, confirms a command to turn off the power source of the image-forming apparatus as implemented using the power-source switch and controls the operation of the power-source part, wherein the power-source part includes a primary power-source part and a secondary power-source part, the secondary power-source part receives voltage generated by the primary power-source part and generates another voltage, the memory part receives electric power from the secondary power-source part and operates, the control part stores the recorded data in the memory part when the control part confirms the command to turn off the power source of the image-forming apparatus due to the power-source switch, and, after the recorded data has been stored, stops the operation of the secondary power-source part for supplying electric power to the memory part.

4. The image-forming apparatus according to claim 1, wherein the fixing motor makes to rotate at a minimal torque enabling the rotating heating body and the rotating pressing body to rotate without welding occurring, the minimal torque being the second torque.

5. The image-forming apparatus according to claim 2, further comprising a notification part for making notification of an abnormal occurrence in the fixing device when it is detected that the fixing motor is not rotating during application of the second torque by using the rotation detector, and the application of electric power to the fixing motor has been stopped.

6. The image-forming apparatus according to claim 1, wherein the fixing device is unitized; and the drive-transmitting part is connected to the fixing motor and includes a main-side drive-transmitting part and a fixing-side drive-transmitting part; the main-side drive-transmitting part having gears provided to a main body of the image-forming apparatus; the fixing-side drive-transmitting part being provided to the fixing device and having gears for causing rotation of the rotating pressing body and the rotating heating body; and the fixing device being attached to the image-forming apparatus, whereby the gear of the main-side drive-transmitting part and the gear of the fixing-side drive-transmitting part intermesh, and the rotating pressing body and the rotating heating body are thereby made to rotate due to the drive force of the fixing motor.

7. The image-forming apparatus according to claim 1, wherein the memory part erases the recorded data once the fixing motor has initiated rotation using the first torque or the second torque, and the rotational speed of the fixing motor has thereafter reached a normal rotational speed determined in advance.

8. The image-forming apparatus according to claim 1, wherein the power-source part performs a welding-preventing process for blocking energization of the heater, and the fixing motor performs a welding-preventing process for causing the rotating heating body to rotate and reducing the temperature, when the power-source switch is pushed.

9. A method for controlling an image-forming apparatus, comprising the following steps:

causing a power-source part to generate a voltage necessary for operating the image-forming apparatus;

energizing a heater and heating a rotating heating body;

pressing a rotating pressing body against the rotating heating body to form a nip portion, the rotating pressing body having an elastic layer;

causing paper onto which a toner image has been transferred to pass through the nip portion and undergo fixation;

using a power-source switch to turn off a power source of the image-forming apparatus;

storing in a memory part recorded data indicating that the power source of the image-forming apparatus was turned off due to operation of the power-source switch;

applying electric power, when the memory part is activated due to powering-on of the image-forming apparatus, to a fixing motor for initiating rotation of the fixing motor at a first torque when the memory part stores the recorded data concerning a previous instance of turning off of the power source of the image-forming apparatus;

applying electric power, when the recorded data is absent from the memory part, to the fixing motor for initiating rotation of the fixing motor at a second torque that is less than the first torque;

using the fixing motor to cause the rotating heating body and the rotating pressing body to rotate; and using a drive-transmitting part to transmit drive force of the fixing motor to one or both of the rotating pressing body and the rotating heating body and to cause the rotating pressing body and the rotating heating body to rotate.

10. The method for controlling an image-forming apparatus according to claim 9, further comprising:

using a rotation detector to detect whether the fixing motor is rotating, stopping the application of electric power to the fixing motor when the rotation of the fixing motor is not detected during application of the second torque; and increasing the rotational speed of the fixing motor to a normal rotational speed when the rotation of the fixing motor is detected during application of the second torque, the normal rotational speed being determined in advance.

11. The method for controlling an image-forming apparatus according to claim 10, further comprising making a notification of an abnormal occurrence in the fixing device when it is detected the rotation of the fixing motor is not detected by using the rotation detector during application of the second torque, and the application of electric power to the fixing motor has been stopped.

12. The method for controlling an image-forming apparatus according to claim 9, further comprising:

causing a control part to confirm a command to turn off the power source of the image-forming apparatus as implemented using the power-source switch;

using the control part to control the operation of the power-source part;

causing a secondary power-source part to receive voltage generated by a primary power-source part and generate another voltage;

supplying electric power from the secondary power-source part and causing the memory part to operate;

storing the recorded data in the memory part when the control part confirms the command to turn off the power source of the image-forming apparatus; and causing the operation of the secondary power-source part for supplying electric power to the memory part to be stopped after the recorded data has been stored.

13. The method for controlling an image-forming apparatus according to claim 9, further comprising causing the fixing motor to rotate at a minimal torque for enabling rotation of the rotating heating body and the rotating pressing body without welding occurring, the minimal torque being the second torque.

14. The method for controlling an image-forming apparatus according to claim 9, further comprising:

making the fixing device to be unitized;

connecting the drive-transmitting part to the fixing motor;

causing the drive-transmitting part to have a main-side drive-transmitting part and a fixing-side drive-transmitting part, the main-side drive-transmitting part having gear provided to a main body of the image-forming apparatus, and the fixing-side drive-transmitting part being provided to the fixing device and having gear for causing the rotating pressing body and the rotating heating body to rotate;

attaching the fixing device to the image-forming apparatus and intermeshing the gears of the main-side drive-transmitting part and the gears of the fixing-side drive-transmitting part; and causing the rotating pressing body and the rotating heating body to rotate due to the drive force of the fixing motor.

15. The method for controlling an image-forming apparatus according to claim 9, further comprising erasing the recorded data once rotation has been initiated using the first torque or the second torque, and the rotational speed of the fixing motor has thereafter reached a normal rotational speed determined in advance.

16. The method for controlling an image-forming apparatus according to claim 9, further comprising, when the power-source switch has been pushed, performing a welding-preventing process for blocking energization of the heater, and performing a welding-preventing process for causing the fixing motor to rotate, causing the rotating heating body to rotate, and reducing the temperature.

* * * * *